US005975676A

United States Patent [19]

Saijo

[11] Patent Number: 5,975,676

[45] **Date of Patent: *Nov. 2, 1999**

[54] INK JET RECORDING APPARATUS AND RECOVERY PROCESSING DEVICE FOR SAID APPARATUS

[75] Inventor: Yasutsugu Saijo, Tokyo, Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/270,484

[22] Filed: Jul. 5, 1994

[30] Foreign Application Priority Data

Jul. 6, 1993 [JP] Japan ..... 5-167070

[51] Int. Cl.[6] ..... B41J 2/165

[52] U.S. Cl. ..... 347/22; 347/30

[58] Field of Search ..... 347/30, 24, 22, 347/32

[56] References Cited

U.S. PATENT DOCUMENTS

| | | | |
|---|---|---|---|
| 4,313,124 | 1/1982 | Hara | 347/57 |
| 4,345,262 | 8/1982 | Shirato et al. | 347/57 |
| 4,459,600 | 7/1984 | Sato et al. | 347/47 |
| 4,463,359 | 7/1984 | Ayata et al. | 347/56 |
| 4,558,333 | 12/1985 | Sugitani et al. | 347/65 |
| 4,608,577 | 8/1986 | Hori | 347/66 |
| 4,723,129 | 2/1988 | Endo et al. | 347/56 |
| 4,740,796 | 4/1988 | Endo et al. | 347/56 |
| 4,825,231 | 4/1989 | Nozaki | 347/30 |
| 5,086,305 | 2/1992 | Terasawa | 347/30 |
| 5,245,362 | 9/1993 | Iwata et al. | 347/23 |
| 5,309,180 | 5/1994 | Uchida | 347/30 |
| 5,343,773 | 9/1994 | Lehna | 347/32 |
| 5,486,854 | 1/1996 | Uchida | 347/30 |

FOREIGN PATENT DOCUMENTS

| | | | |
|---|---|---|---|
| 452119 | 10/1991 | European Pat. Off. | 347/30 |
| 54-056847 | 5/1979 | Japan . | |
| 59-123670 | 7/1984 | Japan . | |
| 59-138461 | 8/1984 | Japan . | |
| 60-071260 | 4/1985 | Japan . | |

*Primary Examiner*—N. Le
*Assistant Examiner*—Thien Tran
*Attorney, Agent, or Firm*—Fitzpatrick, Cella, Harper & Scinto

[57] ABSTRACT

An ink jet recording apparatus comprises an ink jet head provided with discharge ports for discharging the ink, pressure producing element for producing a pressure for maintaining or recovering the discharge conditions of the ink through said discharge ports by compulsorily discharging the ink through said discharge ports, communicating element for communicating said pressure producing element to said ink jet head, and a driving source for driving said pressure producing element and said communicating element. Each of said pressure producing element and said communicating element is provided with a drive selection mechanism so that either said pressure producing element or said communicating element is selectively driven depending on the rotational direction of said driving source.

14 Claims, 11 Drawing Sheets

INK JET RECORDING APPARATUS AND RECOVERY PROCESSING DEVICE FOR SAID APPARATUS

BACKGROUND OF THE INVENTION

1. Field of the Invention

The present invention relates to an ink jet recording apparatus and a recovery processing device for said apparatus, and more particularly to an ink jet recording apparatus and a recovery processing device for said apparatus with which the normal ink discharge conditions of an ink jet head are maintained, or having a recovery system for effecting the recovery.

2. Related Background Art

FIG. 5 is a perspective view showing the schematic constitution of the essence of an ink jet recording apparatus pertaining to the background art.

In FIG. 5, C is an ink jet cartridge, comprised of an ink tank portion located upward in the figure, and a recording head located downward, and further provided with a connector for accepting the signals for driving the recording head. The recording head according to this example has a plurality of discharge ports on the bottom face side in the figure, with elements for generating the energy useful to discharge the ink arranged in the liquid channel portions commucating to the discharge ports. Also, each liquid channel communicates to a common liquid chamber in which the ink supplied from the ink tank portion is received. Note that the above elements may be preferably electricity-heat conversion elements for generating the heat energy which serves as the energy for use in discharging the ink, because of the capability of higher integration of discharge ports or liquid channels.

2 is a carriage, which can mount four cartridges C (C1, C2, C3, C4; corresponding to inks of different colors, for example, yellow, magenta, cyan and black) by positioning, and has a connector holder for transmitting the signals for driving the recording head to enable the electrical connection to the recording head.

11 is a scanning rail, extending along the main scan direction of the carriage 2, for supporting the carriage 2 for free sliding movement, and 52 is a drive belt for transmitting the driving force to reciprocate the carriage 2. Also, a conveying roller pair consisting of conveying rollers 15, 16 and a conveying roller pair consisting of conveying rollers 17, 18 are placed before and after the recording position with the recording head to convey the recording medium therebetween. P is the recording medium such as sheet, which is pressed on a platen (not shown) for regulating the record plane of the recording medium P flat. A recording head portion of the ink jet cartridge C mounted on the carriage 2 is protruded downward in the figure from the carriage 2 to be located between recording medium conveying rollers 16, 18, with the discharge port formation face of the recording head portion opposed to and parallel to the recording medium P pressed on a guide plane of the platen (not shown).

In the ink jet recording apparatus of this example, a recovery system unit 200 as recovery means is disposed on the home position side which resides to the left of FIG. 5. In the recovery system unit 200, 300 is a cap unit provided corresponding to a plurality of ink jet cartridges C having recording heads, this cap unit being movable up and down. And when the carriage 2 is located at a home position, it engages and caps the recording head portion, preventing the ink within the discharge ports of the recording head from evaporating, thickening, and fixing to cause a discharge failure.

Also, in the recovery system unit, 500 is a pump unit in communication with the cap unit 300, which is used to produce a negative pressure required for a suction recovery processing which is effected by joining together the cap unit 300 and the recording head in case where any discharge failure accidentally occurs in the recording head. Further, in the recovery system unit, 401 is a blade as a wiping member formed of an elastic material such as rubber, and 402 is a blade holder for holding the blade 401. In this example, with a blade lifting mechanism (not shown) to be driven by the movement of the carriage 2, the blade 401 supported by the blade holder 402 can be set at either of two positions, i.e., a projected (upward) position (wiping position) to wipe the ink adhering to the discharge port formation face of the recording head and a retracted (downward) position (standby position) not to interfere with the discharge port formation face of the recording head.

The pump unit will be described below. This pump unit has a pump for the recovery disposed to such the ink through the discharge ports by utilizing a negative pressure produced by the pump, for the purposes of maintaining the normal ink discharge conditions of the ink jet head or recovering the ink jet head into the normal ink discharge conditions in cases where the clogging occurs in the discharge port. A constitutional example of this pump involves the use of what is called a tube pump which produces negative pressure by changing the volume of a flexible tube (e.g., Japanese Laid-Open Patent Application No. 1-122880).

FIGS. 6A and 6B are views showing the schematic constitution of the tube pump.

First, an opening portion of the cap 30 is brought into contact with the ink jet head 1 to effect the capping on the discharge port formation face 1A. Another opening portion is provided on the back face side of the cap 30, with a tube 3 that is a component of the tube pump connected thereto. A pressure roller 5 is provided for pressing the tube 3, with a shaft portion 5A rotatably supported by a guide roller 4. A shaft portion 4A of the guide roller 4 is attached rotatably to a pump base 6. Also, the pump base 6 is formed with a circular groove 6A which is coaxial with the shaft of the guide roller 4.

In the above constitution, if the guide roller 4 is rotated in a direction of the arrow a by driving means, not shown, the pressure roller 5 on the guide roller 4 makes contact with and presses the tube 3 at a portion of X in FIG. 6A, compressing the tube 3 until the space inside the tube at the pressed portion becomes null. If the guide roller 4 is further rotated in the direction of the arrow a from this state, the pressure roller 5 is caused to rotate in a direction of the arrow b while compressing the tube 3. And it is temporarily stopped at a portion of Y in FIG. 6B. At this time, a negative pressure occurs on the discharge port formation face 1A of the head 1 by volume changes within the tube compressed by the pressure roller 5 which has been moved from the position X to Y, thereby effecting the suction operation through the discharge ports. Also, a waste ink processing member 7 for reserving the ink drawn through the discharge ports owing to suction is disposed downstream of the tube 3.

The recovery operation will be described below in detail using FIGS. 7 and 8.

When the clogging occurs in the discharge ports 1A of the ink jet head 1, the suction recovery operation is performed at the home position.

At the home position, the opening portion of the cap unit 300 is placed into contact with the ink jet head 1 to effect the capping on the discharge port formation face 1A. On the back face side of the cap 300 is provided another opening portion, to which a tube 503 that is a component of the tube pump is connected.

The tube 503 has flexibility at least on the pressed portion, with the pressure roller 505 for pressing that portion attached rotatably around a shaft portion 505A thereof to a roller bearing 508. The roller bearing 508 is held by a columnar shaft 508A, which is accommodated within a hole 504B provided on a guide roller 504 with a compression spring 510 attached around the circumference of the shaft. Also, the roller bearing 508 is secured by an E-type retaining ring. And the pressure roller 505 is biased by the compression spring 510 in a direction of pressing the tube 503. Also, the positioning of the roller bearing 508 is made by a locator pin 508B provided on the roller bearing 508 being guided by a guide groove 504C provided on the guide roller, and the shaft 508A being guided by the guide hole 504B of the guide roller 504.

The shaft portion 504A of the guide roller 504 is rotatably attached to a pump base 506 via a bearing 511. An E-type retaining ring 512 is disposed to prevent the bearing 511 from coming off. Also, a circular groove 506A coaxial with the shaft of the guide roller 504 is formed in the pump base 506. The pump base 506 is attached to a base 513 of the apparatus main body on the opening side of the circular groove 506A. This is aimed to provide the pump base 506 with the function of a cover to cover a pump operation portion with the pump base 506 in the attached state of the pump base 506, thereby preventing the operator from touching the pump operation portion carelessly and causing a malfunction, and preventing the foreign matter from entering the pump operation portion.

The tube 503 is secured by being squeezed within a tube securing groove 506B provided on the pump base 506.

In this way, if the guide roller 504 is rotated in a direction of the arrow a in the pump unit 500, the pressure roller 505 is brought into contact with a roller guide portion 506C formed integrally with the tube securing groove 506B provided on the pump base 506 (at a position Z as indicated by the two-dot chain line in FIG. 7). At this time, the pressure roller 505 is caused to rotate in a direction of the arrow b and move gradually in a direction of the arrow f (toward the center of the roller 504) and upward to a position equivalent to the state where the pressure roller 505 is pressing the tube 503, while being guided by the roller guide portion 506. And if the guide roller 504 is further rotated in the direction of the arrow a, the pressure roller 505 comes into contact with and presses the tube 503 at position X as indicated by the alternate long and short dash line, compressing the tube 503 until the space inside the tube of the pressing portion becomes null. Because when this pressure roller moves from the position Z to the position X, the pressure roller 505 is shifted in the f direction up to a position equivalent to the state where it is already pressing the tube 503 at position Z, and situated at the position Z, it is possible to suppress the abrupt increase of the force acting on the pressure roller 505 when the pressure roller 505 moves to the position X.

If the guide roller 504 is further rotated in the direction of the arrow a from the state with the pressure roller 505 at position X, the pressure roller 505 is caused to rotate in the direction of the arrow b and move while compressing the tube 503. And it is temporarily stopped at position Y as indicated by the dotted line. At this time, a negative pressure produced by volume changes of the tube 503 compressed by the pressure roller 505 during the movement from position X to position Y is exerted on the discharge port formation face 1A of the head 1, effecting the suction operation through the discharge ports.

Note that a waste ink processing member 507 for reserving the ink drawn through the discharge ports by suction is disposed downstream of the tube 503.

After suction, if the guide roller 504 is further rotated in the direction of the arrow a, the pressure roller 505 gradually leaves away from the tube 503 along a roller guide 508C' taking the same configuration as the roller guide 506C. The movement of the pressure roller 505 is reverse to that when the pressure roller 505 makes contact with the tube 503. Hence, the torque variation encountered when the pressure roller 505 is released from the pressed state of the tube 503 can be reduced at this time.

Next, the driving of the pressure roller 505 and the cap unit 300 will be described below with reference to FIGS. 9 to 11. A motor 521 is secured to a housing and has a motor gear 521*a* at its end portion. An intermediate gear 522 is rotatably supported around its support shaft to the housing, mating with each of a motor gear 521*a*, a pump gear 504D and a cam gear 523C. The pump gear 504D is formed integrally with the guide roller 504 (see FIG. 8) which axially supports the pressure roller 505 as previously described via a roller bearing. The cam gear 523C, together with a cam 523*b* formed integrally therewith, is rotatably supported around its support shaft 523*a*, 523*d* to the housing. Also, the cap unit 300 is supported to the housing to be movable vertically in the figure by making contact with the cam 523*b* as shown in FIG. 9, with its vertical position regulated by a normal shaft 302 coming contact with the cam 523*b*. A pipe 301 of the cap unit 300 is connected to the tube 503 as previously described in connection with the pump. An ink jet head 1 having the discharge port formation face 1A is placed above the cap unit 300.

First, the ink jet head 1 to be subjected to the suction recovery is moved above the cap unit 300 as shown in FIG. 9. If the motor 521 is rotated in a counterclockwise direction as indicated by A in the figure, the pump gear 504D and the cam gear 523C are rotated via the intermediate gear 522 in the same counterclockwise direction as indicated by A. Then, the cap unit 300 in contact with the cam 523*b* is moved in the upward direction in the figure to cap the discharge port formation face 1A as shown in FIG. 11. At the same time, the pressure roller 505 compresses the tube 503 as shown in FIG. 11 as the roller is rotated, so that a negative pressure is produced in accordance with the process as previously described to such the ink from the discharge port formation face 1A. If the motor A is further rotated, the pressure roller 505 is brought into a state as indicated by the two-dot chain line in FIG. 11 and the suction is stopped. At this time, the cam 523*b* also resides in a state as indicated by the two-dot chain line to maintain the capping state. If the motor A is further rotated, the cap unit 300 begins to fall, resulting in a cap open state as shown in FIG. 9.

However, in the above example pertaining to the background art, albeit an advantage that the driving of the pump and the driving of the cam for capping can be effected with a single driving source, there was a problem that only one type of the ink suction amount can be set because the respective driving is interlinked.

That is, the motor driving to operate the pump is stopped halfway, the suction amount less than that at the maximum stroke can be obtained, but if the motor is further driven to open the cap, the suction operation is resumed, resulting in the final suction amount being equal to that at the maximum stroke. As a result, the ink may be sucked by the maximum suction amount, depending on the state of the ink jet head, even though the recovery can be effected only with a small suction amount, and the ink is wastefully consumed.

If one suction amount of the pump is set to the minimum value as necessary to eliminate the waste of the ink, the pump must be rotated by many times when the maximum suction amount is required, giving rise to a waste of time as well as causing a durable problem because of the repeated contact and separation between the ink jet head and the cap which is essentially unnecessary.

SUMMARY OF THE INVENTION

The present invention has been achieved in the light of the aforementioned problems associated with the background art, and its objective is to provide an ink jet recording apparatus and a recovery processing device for said apparatus wherein the driving source for a pump and that for the capping are the same but they can be independently driven, without consuming the ink wastefully and producing waste of time.

It is another object of the present invention to provide an ink jet recording apparatus comprising, an ink jet head provided with discharge ports for discharging the ink, pressure producing means for producing a pressure for maintaining or recovering the discharge conditions of the ink through said discharge ports by compulsorily discharging the ink through said discharge ports, communicating means for communicating said pressure producing means to said ink jet head, and a driving source for driving said pressure producing means and said communicating means, characterized in that each of said pressure producing means and said communicating means is provided with a drive selection mechanism so that either said pressure producing means or said communicating means is selectively driven depending on the rotational direction of said driving source.

It is yet another object of the present invention to provide an ink jet recording apparatus comprising, pressure producing means for producing a pressure for maintaining or recovering the discharge conditions of the ink through discharge ports by compulsorily discharging the ink through said discharge ports of an ink jet head, communicating means for communicating said pressure producing means to said ink jet head, and a driving source for driving said pressure producing means and said communicating means, characterized in that each of said pressure producing means and said communicating means is provided with a drive selection mechanism so that either said pressure producing means or said communicating means is selectively driven depending on the rotational direction of said driving source.

In the present invention, since pressure producing means for use in the recovery of the ink jet head and communicating means for passing a pressure produced by said pressure producing means to the ink jet head can be selected by first and second drive selection mechanisms, depending on the rotational direction of the driving source, without being interlocked, the capping state can be rapidly released after communicating state (capping state) is effected by the communicating means and a desired amount of ink is sucked by the pressure producing means, thereby bringing about no unnecessary suction of the ink.

That is, according to the present invention, the suction amount of ink in recovering the ink jet head can be optionally set by optionally selecting the stroke of pressure producing means even with a single driving source. Thereby, there is the effect that the waste of the ink can be eliminated because the suction can be effected with a smaller amount if required, depending on the state of the ink jet head.

Also, when a large amount of suction is required, it is unnecessary to operate pressure producing means many times, resulting in less waste of time, and it is advantageous from the aspects of the head water-repellency and the durability of the cap which may degrade due to the repeated contact and separation between the ink jet head and the cap which is essentially unnecessary.

DESCRIPTION OF THE PREFERRED EMBODIMENTS

The embodiments of the present invention will be described below with reference to the drawings.

Figure 1:
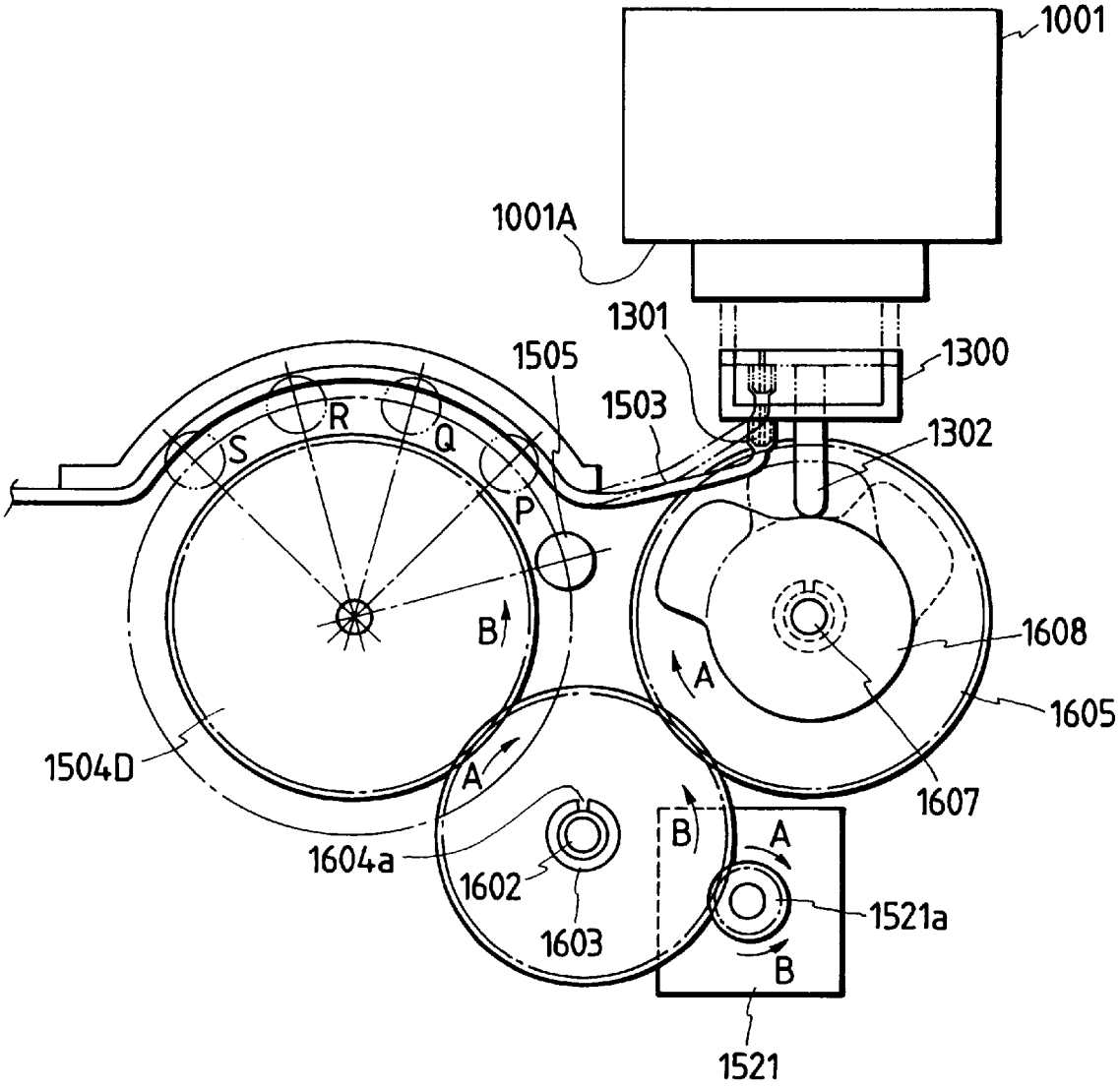
FIG. 1 is a cross-sectional view of the essence of a recovery device according to a first embodiment of the present invention.
Figure 2:
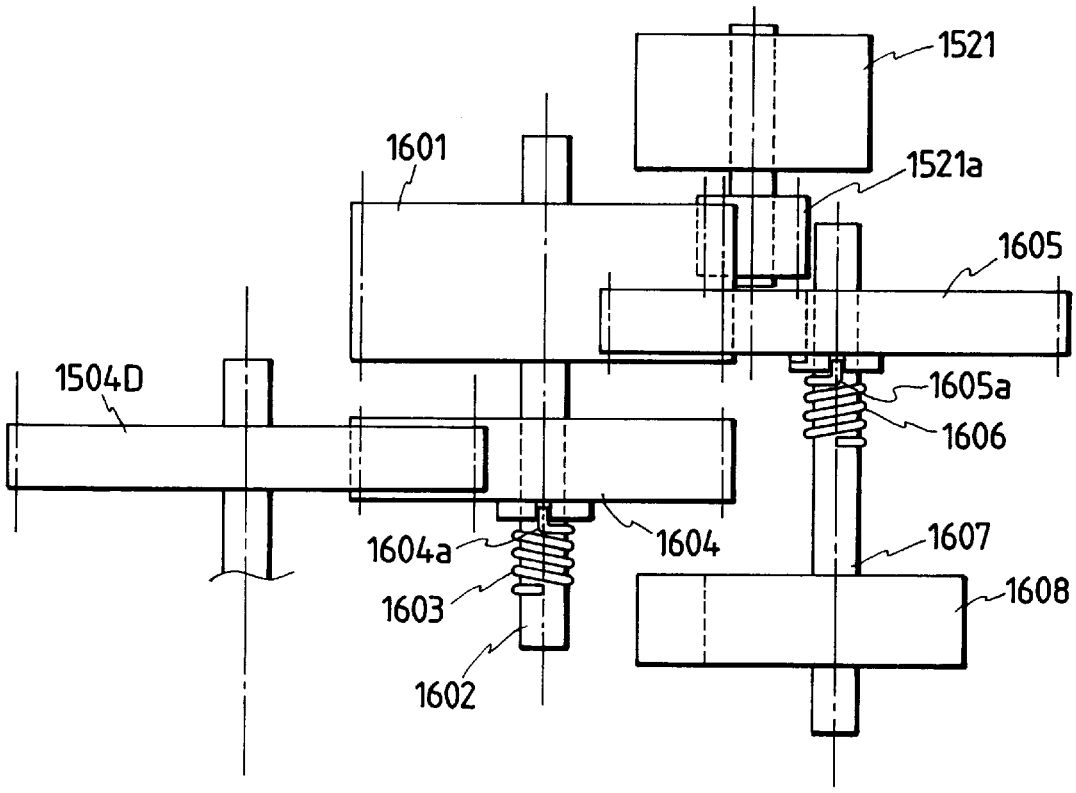
FIG. 2 is an upper view of the essence of the recovery device according to the first embodiment of the present invention.

FIG. 1 is a side view showing the constitution of the essence of one embodiment of the present invention, and FIG. 2 is an upper view thereof.

Figure 7:
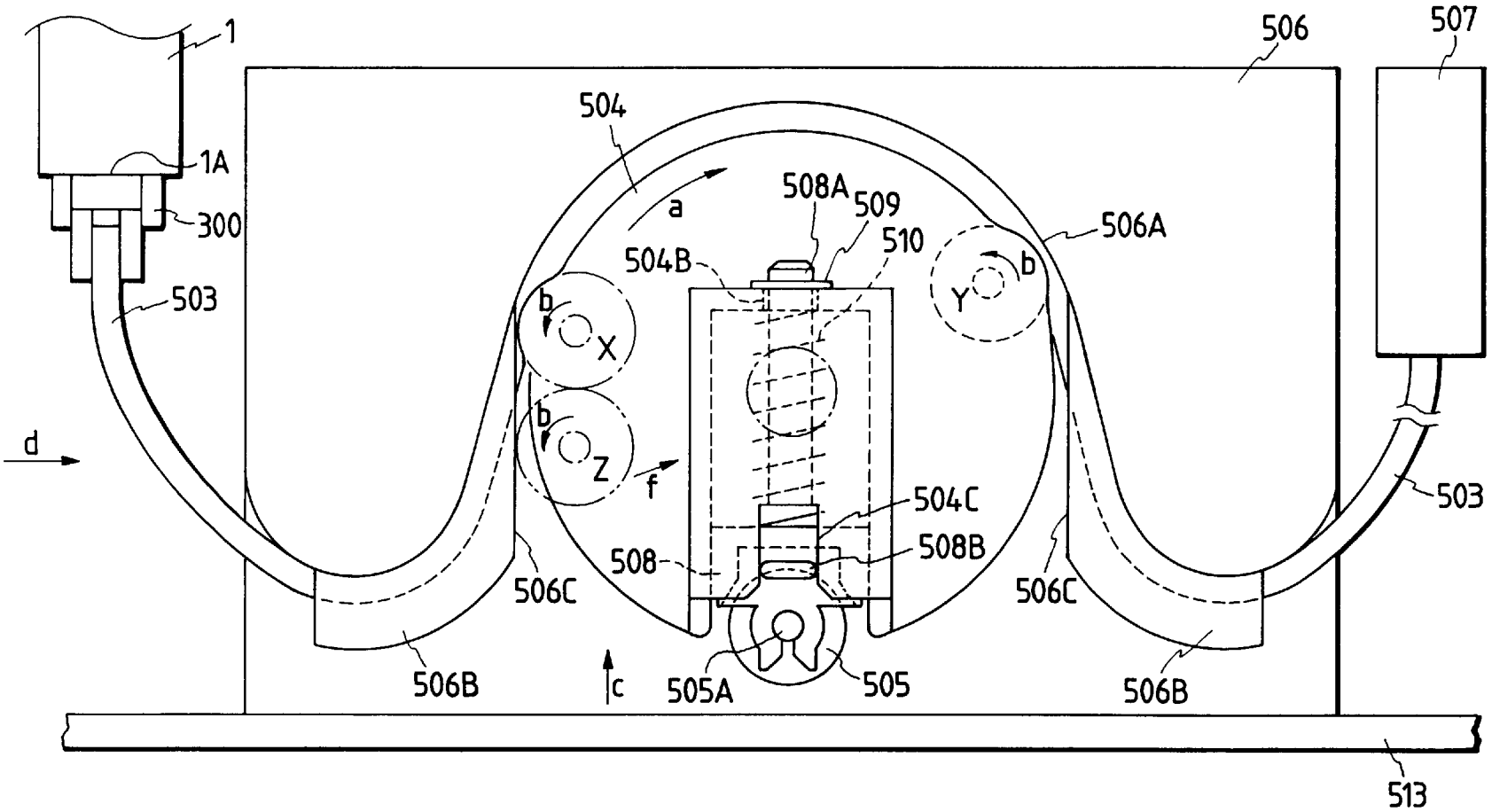
FIG. 7 is a detail cross-sectional view of the tube pump pertaining to the background art.
Figure 8:
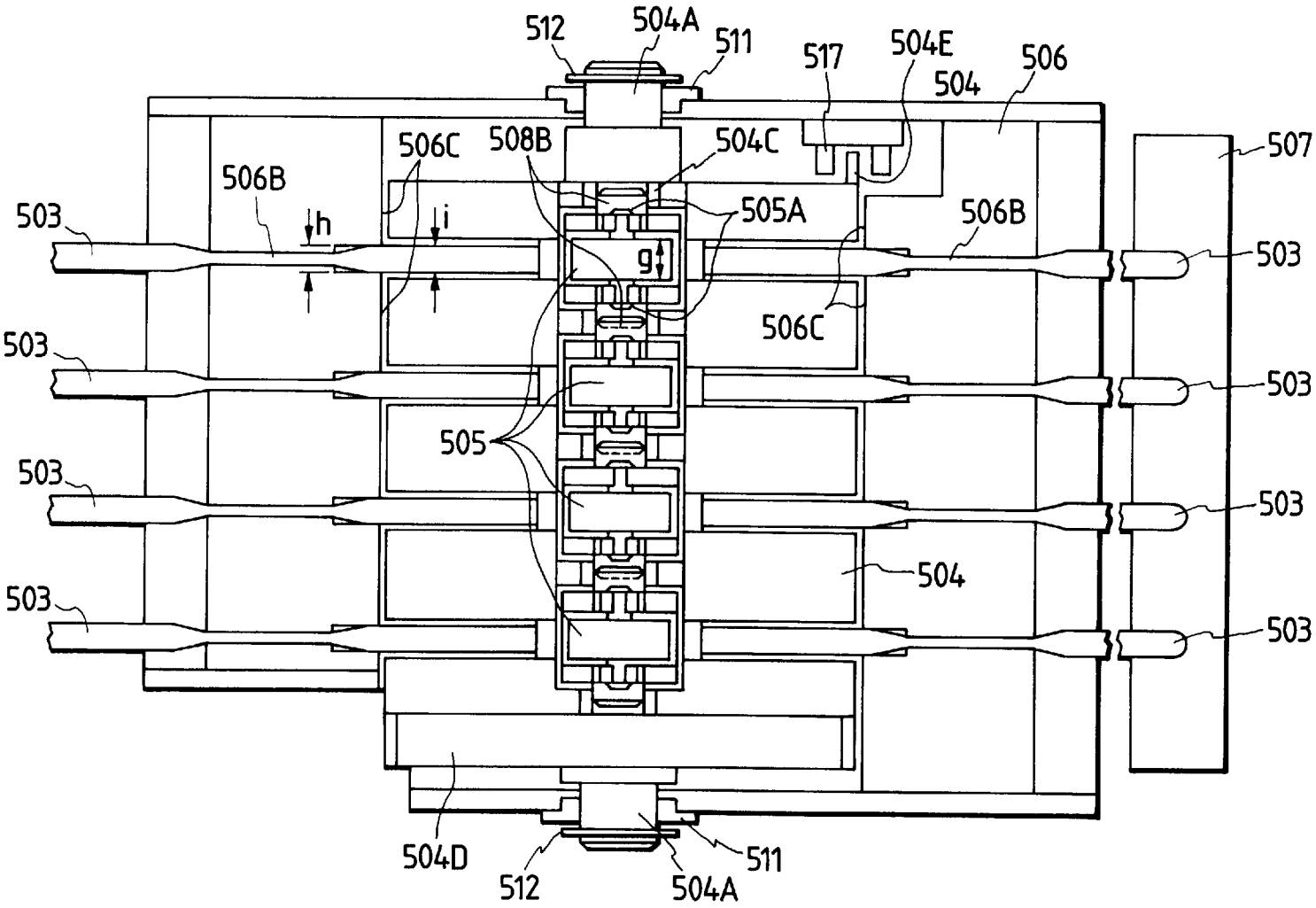
FIG. 8 is an upper view of the tube pump pertaining to the background art.
Figure 9:
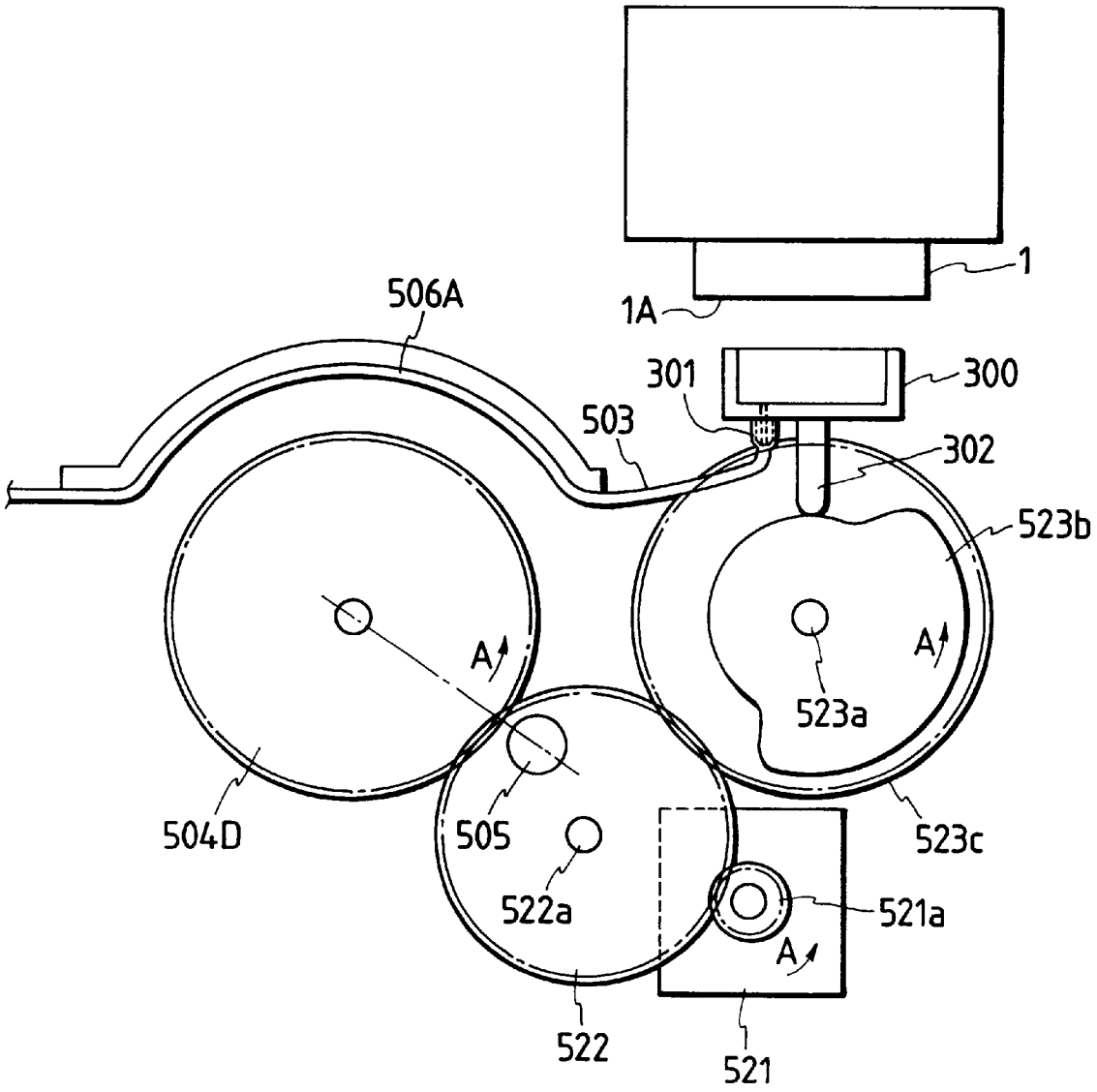
FIG. 9 is a cross-sectional view of the essence of the tube pump on standby pertaining to the background art.
Figure 10:
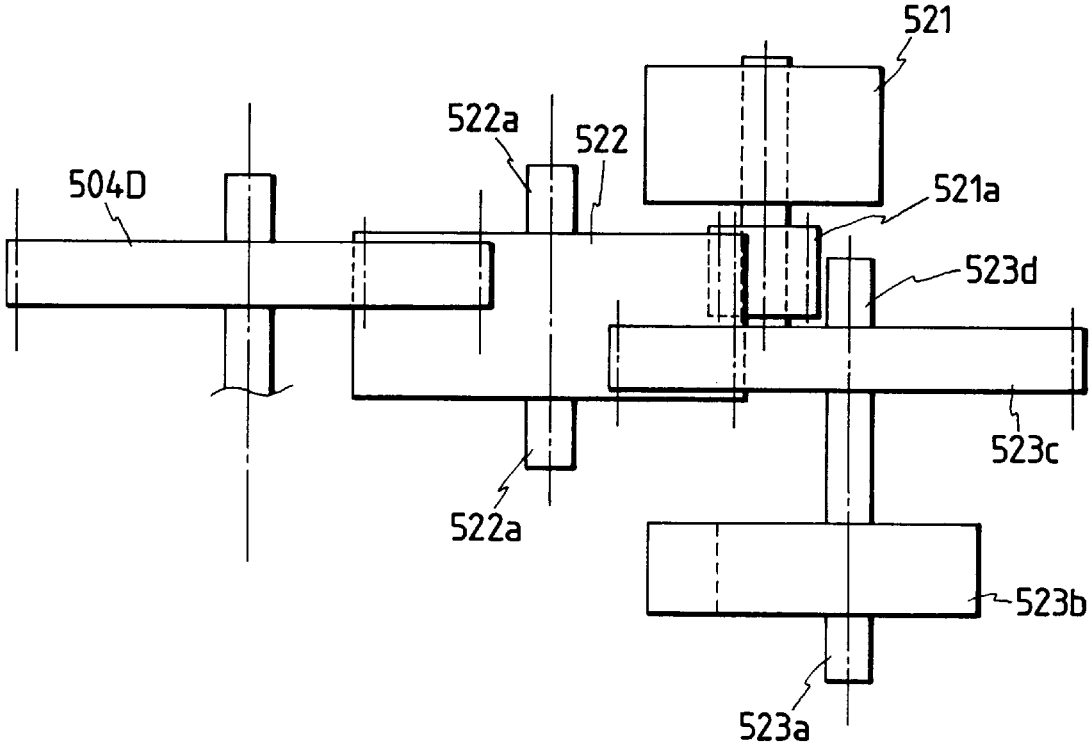
FIG. 10 is an upper view of a driving system of the tube pump pertaining to the background art.
Figure 11:
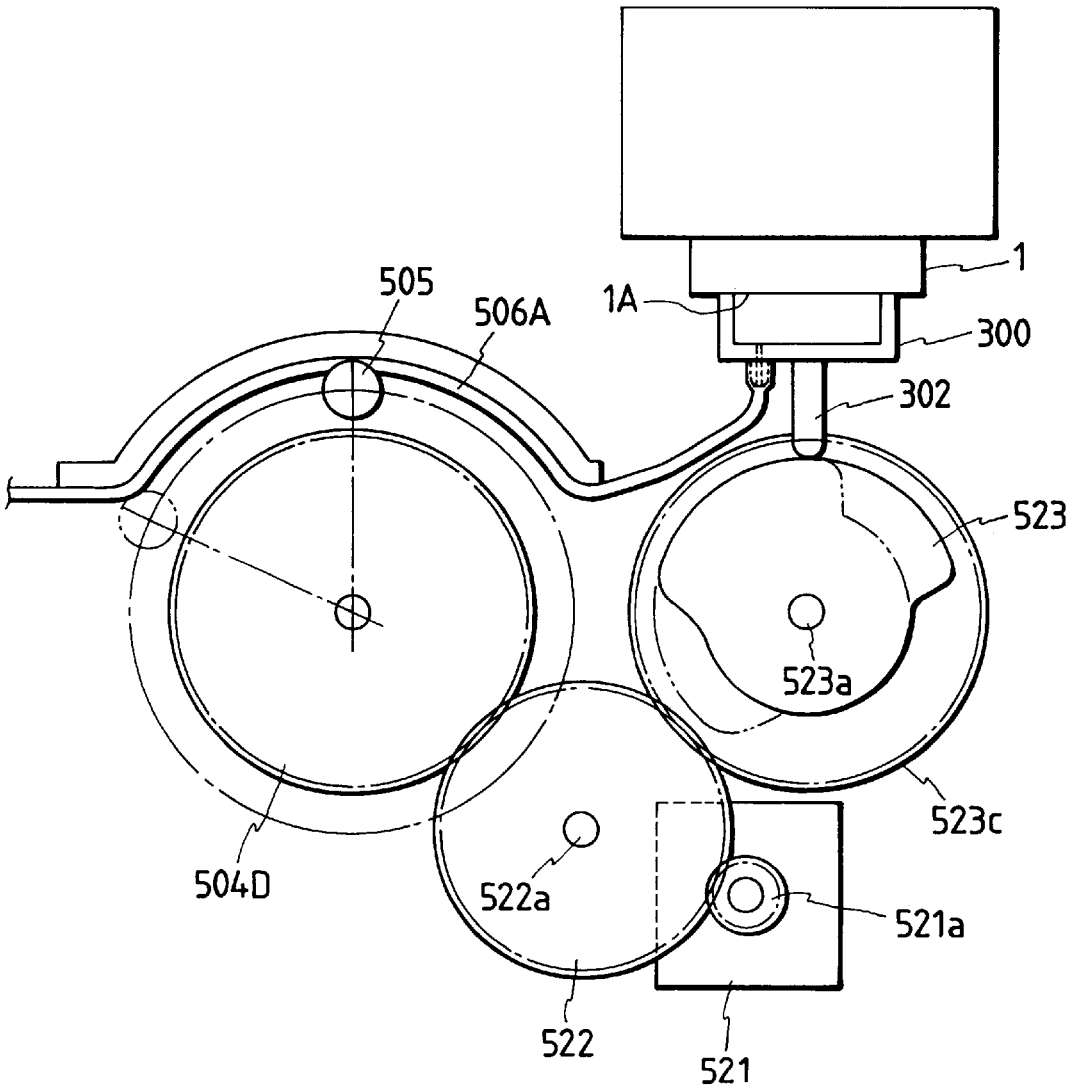
FIG. 11 is a cross-sectional view of the essence of the tube pump during suction pertaining to the background art.

This embodiment utilizes a suction mechanism identical to that as shown in FIG. 7, and the essential parts of this embodiment are only described herein.

A motor 1521 which is a driving source is secured to a housing, and has a motor gear 1521*a* at this end portion. An intermediate gear 1601 mating with the motor gear 1521*a* and a shaft 1602 are connected for integral rotation, and a pump clutch gear 1604 is attached for free rotation around the shaft 1602. A clutch spring 1603 is tightened by counterclockwise rotation and wound around the shaft 1602, with its one end engaged in a notch 1604*a* of the pump clutch gear 1604. A first driving selection mechanism is constituted of the clutch spring 1603, the shaft 1602 and the notch 1604*a*.

The pump clutch gear 1604 is mated with a pump gear 1504D. The pump gear 1504D constitutes pressure producing means, together with a pressure roller 1505 as previously described, and is formed integrally with a guide roller which axially supports the pressure roller 1505 via a roller bearing.

Also, a cam clutch gear 1605 mating with the motor gear 1521*a* is attached for free rotation around a shaft 1607. A clutch spring 1606 is tightened by clockwise rotation, and wound around the shaft 1607, with its one end engaged in a notch 1605*a* of the cam clutch gear 1605. A second driving selection mechanism is constituted of the clutch spring 1606, the shaft 1607 and the notch 1605*a*.

A cam 1608 is coupled to rotate integrally with the shaft 1607. Also, the cap unit 1300 is supported to a housing to be movable up and down, with the vertical position thereof being regulated by a normal shaft 1302 coming into contact with a cam 1608 (communicating means). A tube 1503 is connected to a pipe 1301 of the cap unit 1300.

This embodiment is one in which clutch springs 1603, 1606 having different rotational directions for tightening are used to selectively transmit the force of the motor 1521 to either the cam clutch gear 1605 for vertically moving the cap unit 1300 or the pump gear 1504D for controlling the pressed state of the tube 1503, depending on its rotational direction.

The suction recovery operation in this embodiment as above constituted will be described below.

If the motor 1521 for moving an ink jet head 1001 subjected to the suction recovery upward of the cap unit 1300 is rotated in a clockwise direction as indicated by A in the figure, the cam clutch gear 1605 is also rotated in the same clockwise direction as indicated by A via the intermediate gear 1601. Owing to such rotation, the clutch spring 1606 engages the notch 1605*a* of the cam clutch gear 1605, and is rotated in the clockwise direction as indicated by A. Thereby, the clutch spring 1606 tightens the shaft 1607, and rotates the shaft 1607 in the clockwise direction as indicated by A. As a result of the rotation, the cam 1608 is also rotated in the clockwise direction as indicated by A, forcing the cap unit 1300 up, so that the cap unit 1300 is placed in the capping state as indicated by the two-dot chain line in the figure. Since during this series of operations, the intermediate gear 1601 and the shaft 1602 continue to rotate in a counterclockwise direction as indicated by B in the figure, but the clutch spring 1603 is being loosed, the clutch spring 1603 runs idle around the shaft 1602 without rotation. Hence, the pump clutch gear 1604 does not rotate and the pressure roller maintains the state as indicated by the solid line in the figure.

If the motor 1521 is reversely rotated in the counterclockwise direction as indicated by B in the figure, the intermediate gear 1601 and the shaft 1602 are rotated in the clockwise direction as indicated by A. Then, the clutch spring 1603 is tightened around the shaft 1602, and also rotated in the clockwise direction as indicated by A. Thereby, the end portion of the clutch spring 1603 presses the notch 1604*a* of the pump clutch gear 1604 to rotate the pump clutch gear 1604 in the clockwise direction as indicated by A. Along with this rotation, the pump gear 1504D is also rotated in the counterclockwise direction as indicated by B, while at the same time the pressure roller 1505 is rotated sequentially in the counterclockwise direction as indicated by B. Herein, the pressure roller 1505 is stopped at an arbitrary position such as P, Q, R, S as represented by the two-dot chain line in the figure, in accordance with the necessary suction amount. Since during this series of rotations of the pressure roller 1505, the intermediate gear 1601 and the shaft 1602 continue to rotate in the clockwise direction as indicated by A, to cause the cam clutch gear 1605 to rotate in the counterclockwise direction as indicated by B, but as the clutch spring 1606 is being loosed, no rotation is passed to the shaft 1607, so that the cam does not rotate and the capping state is maintained.

Next, if the motor is reversely rotated in the clockwise direction as indicated by A in the figure, the cam 1608 is rotated in the clockwise direction as indicated by A, as previously described, from the state as indicated by the two-dot chain line to that as indicated by the broken line. Thereby, the cap unit 1300 falls down, changing from the cap state to the open state to cause the ink jet head 1001 to be movable.

Next, a second embodiment of the present invention will be described below.

Figure 3:
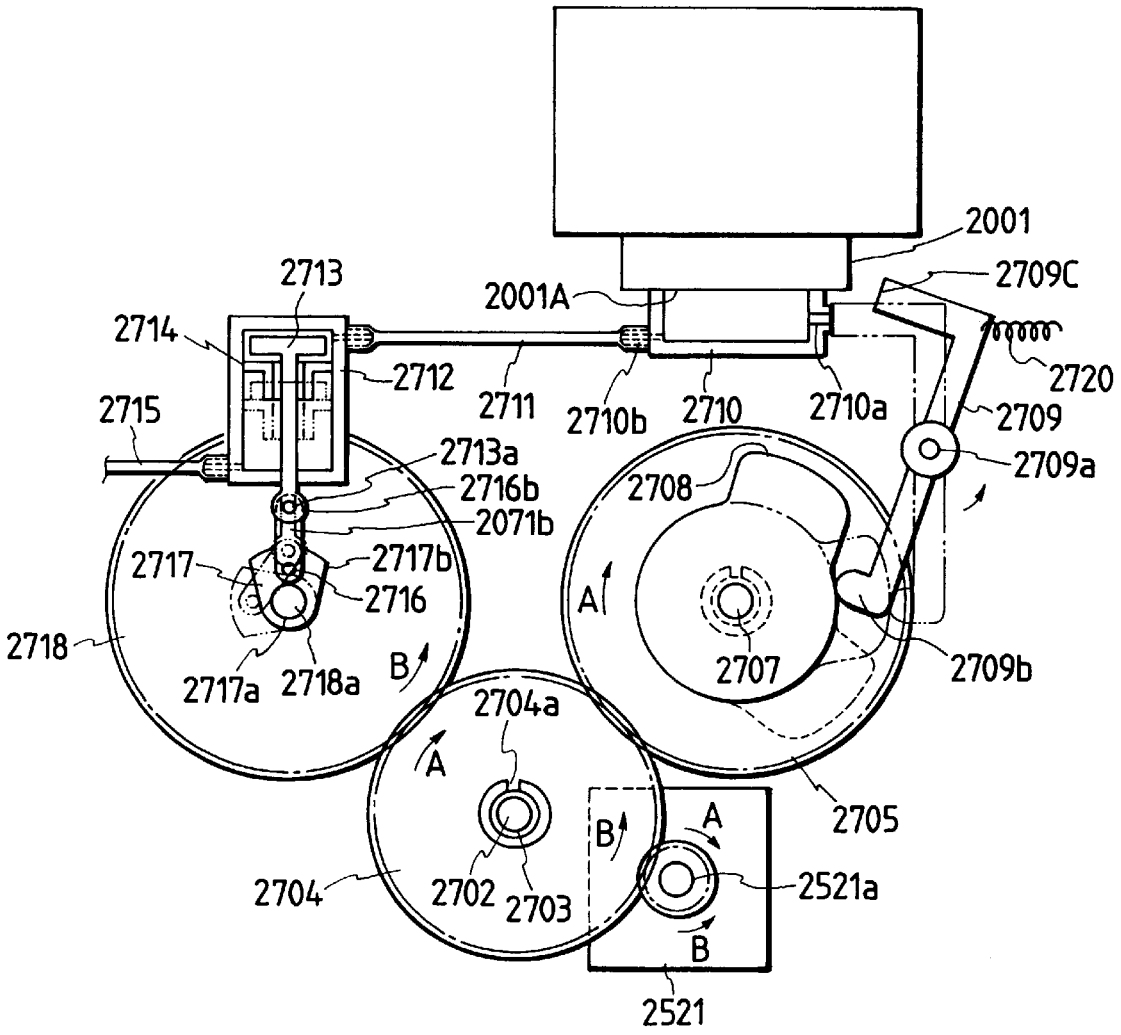
FIG. 3 is a cross-sectional view of the essence of a recovery device according to a second embodiment of the present invention.
Figure 4:
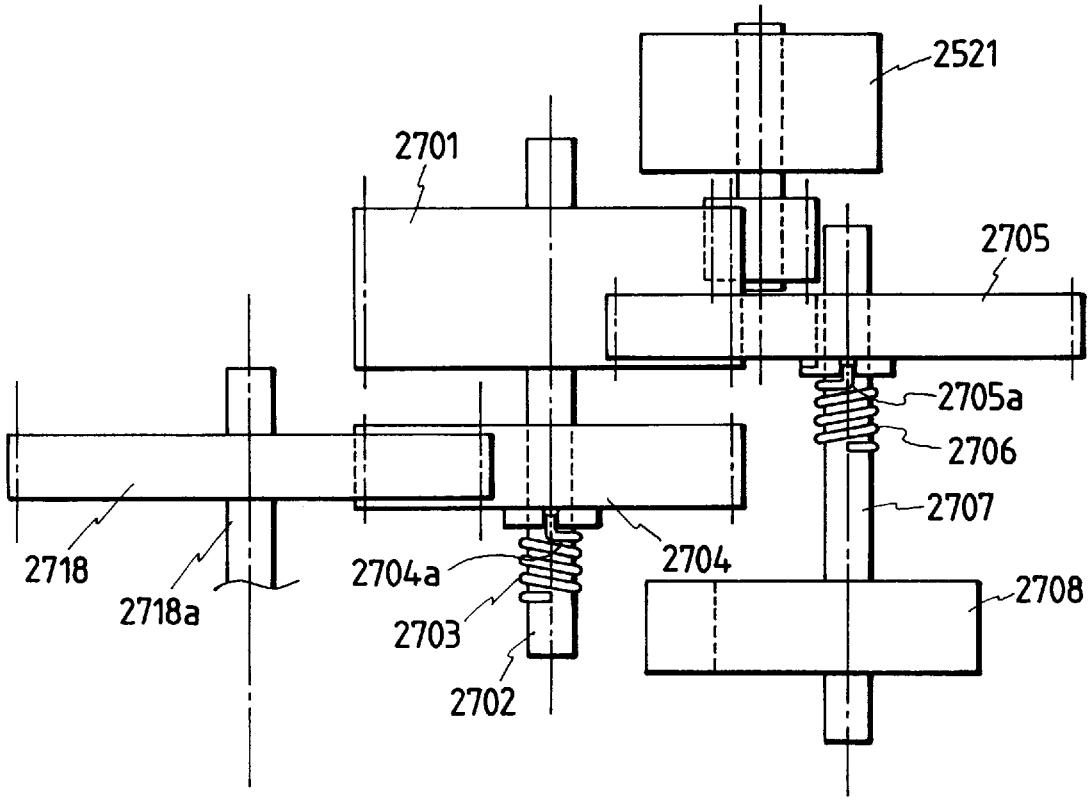
FIG. 4 is an upper view of the essence of the recovery device according to the second embodiment of the present invention.
Figure 5:
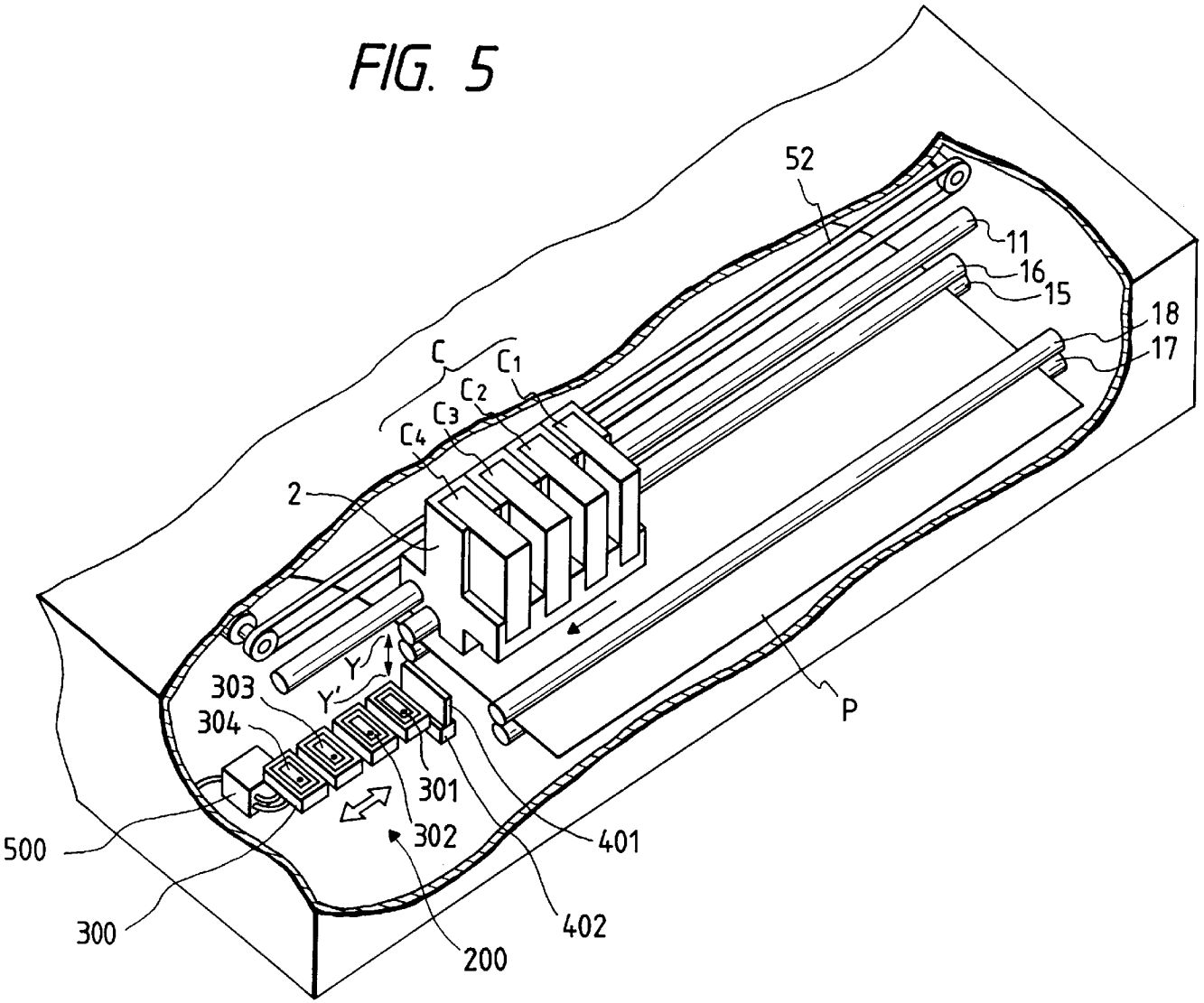
FIG. 5 is a schematic view of an ink jet recording apparatus pertaining to the background art.
Figure 6A:
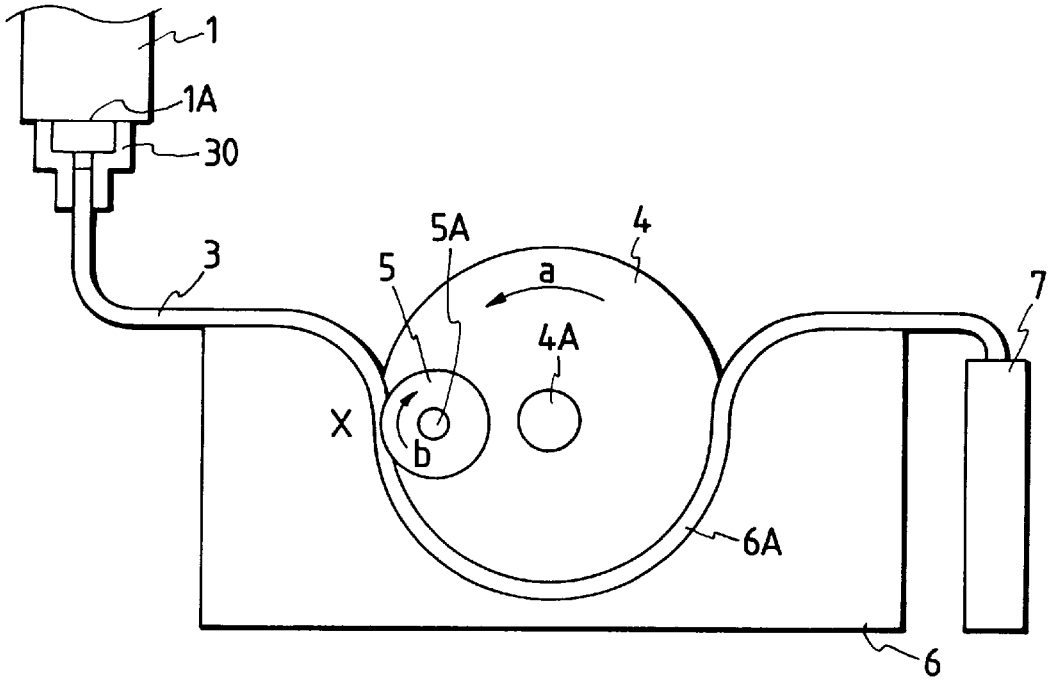
FIGS. 6A and 6B are schematic cross-sectional views of a tube pump pertaining to the background art.
Figure 6B:
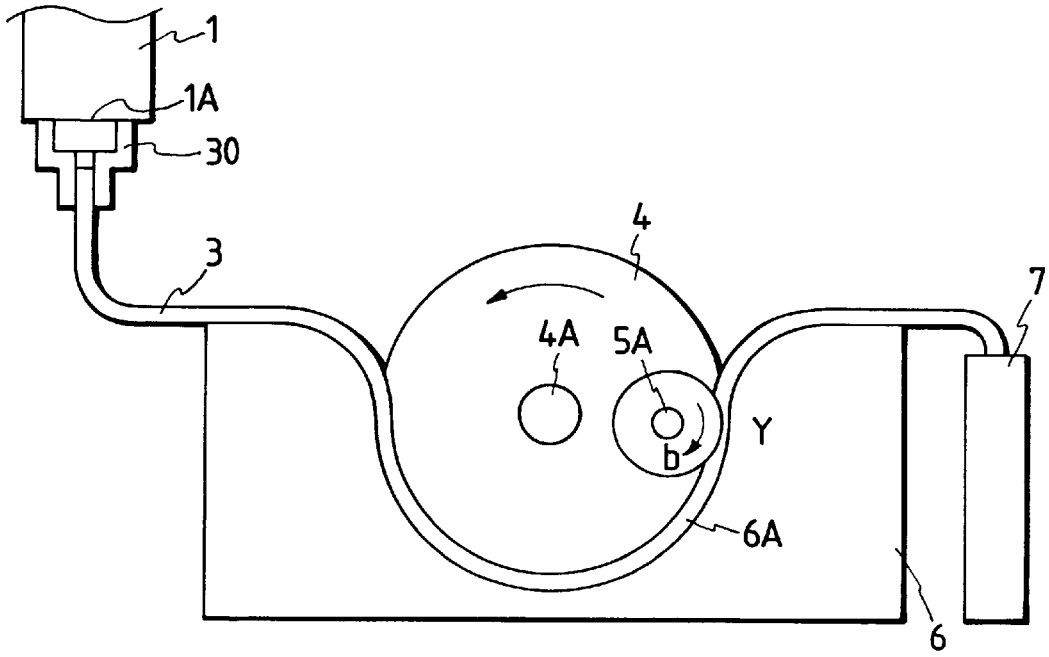

FIG. 3 is a side view showing the constitution of the essence of the second embodiment of the present invention and FIG. 4 is an upper view thereof.

A motor 2521 is secured to a housing, and has a motor gear 2521*a* at its end portion. An intermediate gear 2701 mating with the motor gear 2521*a* is connected for integral rotation with a shaft 2702, and a pump clutch gear 2704 is attached for free rotation to the shaft 2702.

A clutch spring 2703 is tightened by counterclockwise rotation, and wound around the shaft 2702, with its one end engaged in a notch 2704*a* of the pump clutch gear 2704. A first driving selection mechanism is constituted of these components.

The pump clutch gear 2704 is mated with a pump gear 2718 which is supported for free rotation around the shaft 2718*a* to the housing. A rotation plate 2717 is joined for integral rotation with the shaft 2718*a* of the pump gear 2718. A connection plate 2716 has its one end joined for free rotation with a shank 2717*b* of the rotation plate 2717, the other end being joined for free rotation with a shaft 2713*a* of a piston 2713. The piston 2713 is supported to be movable vertically with respect to a cylinder 2712, passing through a hole 2714*a* of a ring 2714 also movable vertically with respect to the cylinder 2712. In this embodiment, pressure producing means is constituted of the cylinder 2712, the piston 2713 and the pump gear 2718.

A pipe 2712*a* above the cylinder 2712 is connected via a tube 2711 to a pipe 2710*b* of a cap 2710. Also, a pipe 2712*b* beneath the cylinder 2712 is connected via a tube 2715 to a waste ink reservoir, not shown.

On the other hand, a cam clutch gear 2705 mated with a motor gear 2521*a* is attached for free rotation to a shaft 2707.

A clutch spring 2706 is tightened by clockwise rotation, and wound around the shaft 2707, with its one end engaged in a notch 2705*a* of the cam clutch gear 2705. A second driving selection mechanism in this embodiment is constituted of these components.

A cam 2708 is coupled for integral rotation with the shaft 2707. A sealing lever 2709 which constitutes communicating means together with the cam 2708 is supported for free rotation around a shaft 2709*a* to a housing, and always biased in the clockwise direction by a spring 2720, with its top end 2709*b* abutting on the cam 2708.

This embodiment is one in which clutch springs 2703, 2706 having different rotational directions for tightening are used to selectively transmit the force of the motor 1521 to either the cam clutch gear 2705 for switching the capping state of the cap unit 2710 or the pump gear 2705 for controlling the pressed state of the tube 2711, depending on its rotational direction.

The suction recovery operation in this embodiment as above constituted will be described below.

If the motor 2521 for bringing the cap 2710 into contact with an ink jet head 2001 subjected to the suction recovery is rotated in a clockwise direction as indicated by A in the figure by a mechanism, not shown, the cam clutch gear 2705 is also rotated in the same clockwise direction as indicated by A via the intermediate gear 2701. Then, the clutch spring 2706 engages the notch 2705*a* of the cam clutch gear 2705, and is rotated in the clockwise direction as indicated by A to tighten the shaft 2707. By this rotation, the shaft 2707 is rotated in the clockwise direction as indicated by A. As a result, the cam 2708 is rotated in the clockwise direction as indicated by A, pressing the top end 2709*b* of the sealing lever 2709, and when the cam 2708 is placed in the state as indicated by the two-dot chain line in the figure, the sealing lever 2709 is also placed in the state as indicated by the two-dot chain line in the figure, resulting in a lid portion 2709*c* sealing the hole 2710*a* of the cap 2710, ready for the suction enable state.

Since during the above series of operations, the intermediate gear 2701 and the shaft 2702 continue to rotate in a counterclockwise direction as indicated by B in the figure, but as the clutch spring 2703 is being loosed, the clutch spring 2703 runs idle around the shaft 2702 without rotation. As a result, the pump clutch gear 2704 does not rotate so that the piston 2713 maintains the state as indicated by the solid line.

Next, if the motor 2521 is reversely rotated in the β direction, the intermediate gear 2701 and the shaft 2702 are rotated in the clockwise direction as indicated by A. Then, the clutch spring 2703 is tightened around the shaft 2702, and also rotated in the clockwise direction as indicated by A. Thereby, the end portion of the clutch spring 2703 presses the notch 2704*a* of the pump clutch gear 2704 to cause the pump clutch gear 2704 to be rotated in the clockwise direction as indicated by A. By this rotation, the rotation plate 2717 is also rotated in the clockwise direction as indicated by A, pulling up the connection plate 2716, the piston 2713, and the ring 2714 gradually. Herein, the rotation plate 2717 is rotated in accordance with the necessary suction amount to place the piston 2713 and the ring 2714 in the state as indicated by the two-dot chain line in the figure, for example.

Since during the above series of operations, the intermediate gear 2701 and the shaft 2702 continue to rotate in the clockwise direction as indicated by A and the cam clutch gear 2705 is rotated in the counterclockwise direction as indicated by B, but as the clutch spring 2706 is being loosed, no rotation is transmitted to the shaft 2707, so that the cam does not rotate and the capping state is maintained.

While in the embodiments as above described, the mechanism for selectively transmitting the rotation of the motor which is a driving source to pressure producing means or communicating means is a clutch spring, but not limited thereto, it should be noted that a ratchet mechanism may be used without having specific limitations.

The present invention brings about excellent effects particularly in a recording head or recording device of the ink jet system of performing the recording by forming flying liquid droplets by the use of the heat energy among the various ink jet recording systems.

As to its representative constitution and principle, for example, one practiced by use of the basic principle disclosed in, for example, U.S. Pat. Nos. 4,723,129 and 4,740,796 is preferred. This system is applicable to either of the so-called on-demand type and the continuous type. Particularly, the case of the on-demand type is effective because, by applying at least one driving signal which gives rapid temperature elevation exceeding nucleus boiling corresponding to the recording information on electricity-heat converters arranged corresponding to the sheets or liquid channels holding a liquid (ink), heat energy is generated at the electricity-heat converters to effect film boiling at the heat acting surface of the recording head, and consequently the bubbles within the liquid (ink) can be formed corresponding one by one to the driving signals. By discharging the liquid (ink) through an opening for discharging by growth and shrinkage of the bubble, at least one droplet is formed. By making the driving signals into the pulse shapes, growth and shrinkage of the bubbles can be effected instantly and adequately to accomplish more preferably discharging of the liquid (ink) particularly excellent in response characteristic.

As the driving signals of such pulse shape, those as disclosed in U.S. Pat. Nos. 4,463,359 and 4,345,262 are suitable. Further excellent recording can be performed by employment of the conditions described in U.S. Pat. No. 4,313,124 of the invention concerning the temperature elevation rate of the above-mentioned heat acting surface.

As the constitution of the recording head, in addition to the combination of the discharging port, liquid channel, and electricity-heat converter (linear liquid channel or right-angled liquid channel) as disclosed in the above-mentioned respective specifications, the constitution by use of U.S. Pat. Nos. 4,558,333 or 4,459,600 disclosing the constitution having the heat acting portion arranged in the flexed region is also included in the present invention.

In addition, the present invention can be also effectively made the constitution as disclosed in Japanese Laid-Open Patent Application No. 59-123670 which discloses the constitution using a slit common to a plurality of electricity-heat converters as the discharging portion of the electricity-heat converter or Japanese Laid-Open Patent Application No. 59-138461 which discloses the constitution having the opening for absorbing pressure wave of heat energy correspondent to the discharging portion.

Further, as the recording head of the full line type having a length corresponding to the maximum width of a recording sheet (recording medium) which can be recorded by the recording device, the present invention can exhibit the effects as described above further effectively, whether the constitution which satisfies its length by a combination of a plurality of recording heads or the constitution as one recording head integrally formed.

In addition, the present invention is effective for a recording head of the freely exchangeable chip type which enables electrical connection to the main device or supply of ink from the main device by being mounted on the main device, or a recording head of the cartridge type having an ink tank integrally provided on the recording head itself.

Also, addition of a restoration means for the recording head, a preliminary auxiliary means, etc., provided as the constitution of the recording device of the present invention is preferable, because the effect of the present invention can be further stabilized. Specific examples of these may include, for the recording head, capping means, cleaning means, pressurization or suction means, electricity-heat converters or another type of heating elements, or preliminary heating means according to a combination of these, and it is also effective for performing stable recording to perform preliminary mode which performs discharging separate from recording.

Further, as the recording mode of the recording device, the present invention is extremely effective for not only the recording mode only of a primary color such as black, etc., but also a device equipped with at least one of plural different colors or full color by color mixing, whether the recording head may be either integrally constituted or combined in plural number.

In addition, though the ink is considered as the liquid in the embodiments as above described, other inks may be also usable which are solid below room temperature and will soften or liquefy at or above room temperature, or liquefy when a use recording signal is issued as it is common with the ink jet device to control the viscosity of ink to be maintained within a certain range of the stable discharge by adjusting the temperature of ink in a range from 30° C. to 70° C.

In addition, in order to avoid the temperature elevation due to heat energy by positively utilizing the heat energy as the energy for the change of state from solid to liquid, or to prevent the evaporation of ink by using the ink which will stiffen in the shelf state, the use of the ink having a property of liquefying only with the application of heat energy, such as liquefying with the application of heat energy in accordance with a recording signal so that liquid ink is discharged, or may be solidifying prior to reaching the recording medium, is also applicable in the present invention. In such a case, the ink may be held as liquid or solid in recesses or through holes of a porous sheet, which is placed opposed to electricity-heat converters, as described in Japanese Laid-Open Patent Application No. 54-56847 or No. 60-71260. The most effective method for the ink as above described in the present invention is based on the film boiling.

Further, a recording apparatus according to the present invention may be used in the forms of an image output terminal for the information processing equipment such as a word processor or a computer which is integrally or separately provided, a copying machine in combination with a reader, or a facsimile terminal equipment having the transmission and reception feature.

What is claimed is:

1. An ink jet recording apparatus comprising:

an ink jet head provided with discharge ports for discharging ink;

pressure producing means for producing a pressure for maintaining or recovering a discharge condition of the ink through said discharge ports by forcibly discharging the ink through said discharge ports;

communicating means for communicating said pressure producing means to said ink jet head;

a bidirectional motor for driving said pressure producing means and said communicating means; and a driving means for driving said pressure producing means with said communicating means closed when said bidirectional motor rotates in one direction and for opening said communicating means when said bidirectional motor rotates in another direction.

2. An ink jet recording apparatus according to claim 1, wherein said pressure producing means comprises a flexible tube, a pressure member for pressing said flexible tube, a pressure guide serving as a backup when said pressure member presses said flexible tube.

3. An ink jet recording apparatus according to claim 1, wherein said ink jet head is provided with heat energy generating means for generating the heat energy as the energy for use in discharging the ink through said discharge ports.

4. An ink jet recording apparatus according to claim 3, wherein said heat energy generating means is electricity-heat converters.

5. An apparatus according to claim 1, wherein a volume of a forcible discharge of the ink through said discharge ports is changed by changing a rotation angle of said bidirectional motor.

6. An apparatus according to claim 1, wherein said communicating means includes a cap for capping said discharge ports.

7. An apparatus according to claim 1, wherein said communicating means is provided with communication means for atmosphere communicating an interior of said communicating means with atmosphere.

8. An apparatus according to claim 1, wherein said bidirectional motor drives said communicating means closed when said communicating means is open and said bidirectional motor rotates in the another direction.

9. A recovery processing device for an ink jet recording apparatus comprising:

pressure producing means for producing a pressure for maintaining or recovering discharge conditions of ink through discharge ports by forcibly discharging the ink through said discharge ports of an ink jet head;

communicating means for communicating said pressure producing means to said ink jet head;

a bidirectional motor for driving said pressure producing means and said communicating means; and a driving means for driving said pressure producing means with said communicating means closed when said bidirectional motor rotates in one direction and for opening said communicating means when said bidirectional motor rotates in another direction.

10. A recovery processing device for the ink jet recording apparatus according to claim 9, wherein said pressure producing means comprises a flexible tube, a pressure member for pressing said flexible tube, a pressure guide serving as a backup when said pressure member presses said flexible tube.

11. A device according to claim 9, wherein a volume of a forcible discharge of the ink through said discharge ports is changed by changing a rotation angle of said bidirectional motor.

12. A device according to claim 9, wherein said communicating means includes a cap for capping said discharge ports.

13. A device according to claim 9, wherein said communicating means is provided with communication means for atmosphere communicating an interior of said communicating means with the atmosphere.

14. A device according to claim 9, wherein said bidirectional motor drives said communicating means closed when said communicating means is open and said bidirectional motor rotates in the another direction.

* * * * *

UNITED STATES PATENT AND TRADEMARK OFFICE

CERTIFICATE OF CORRECTION

PATENT NO. : 5,975,676

DATED : November 2, 1999

INVENTOR(S) : Yasutsugu Saijo

It is certified that error appears in the above-identified patent and that said Letters Patent is hereby corrected as shown below:

COLUMN 12:

Lines 56, "communication" should read --atmosphere communication--; and

Lines 57, "atmosphere" should be deleted.

Signed and Sealed this

Nineteenth Day of September, 2000

*Attest:*

Q. TODD DICKINSON

*Attesting Officer*

*Director of Patents and Trademarks*

UNITED STATES PATENT AND TRADEMARK OFFICE

CERTIFICATE OF CORRECTION

PATENT NO. : 5,975,676

DATED : November 2, 1999

INVENTOR(S) : Yasutsugu Saijo

It is certified that error appears in the above-identified patent and that said Letters Patent is hereby corrected as shown below:

COLUMN 12:

Line 20, "communication" should read --atmosphere communication--; and

Line 21, "atmosphere" should be deleted.

Signed and Sealed this

Twenty-second Day of May, 2001

*Attest:*

Nicholas P. Godici

NICHOLAS P. GODICI

*Attesting Officer*

*Acting Director of the United States Patent and Trademark Office*